US006799987B1

(12) United States Patent
Park et al.

(10) Patent No.: US 6,799,987 B1
(45) Date of Patent: Oct. 5, 2004

(54) WIRE CONNECTING DEVICE

(75) Inventors: Jong Dae Park, Kumi-shi (KR); Se Chang Won, Kumi-shi (KR); In Suk Jeong, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/585,441

(22) Filed: Jun. 2, 2000

(30) Foreign Application Priority Data

Jun. 3, 1999 (KR) ..... 1999-20547

(51) Int. Cl.[7] ..... H01R 4/38; H01R 33/02; H01R 33/08; H01R 13/648

(52) U.S. Cl. ..... 439/375; 439/226

(58) Field of Search ..... 439/587, 589, 439/274, 275, 279, 588, 226, 375

(56) References Cited

U.S. PATENT DOCUMENTS 3,753,193 A * 8/1973 Teagno et al. ..... 439/854
3,771,111 A * 11/1973 Pritulsky ..... 439/850
4,010,992 A * 3/1977 Crimmins et al. ..... 439/70
4,181,390 A * 1/1980 Aizawa ..... 439/375
5,610,472 A * 3/1997 Schmitt, Jr. ..... 313/318.12
5,624,287 A * 4/1997 Newman et al. ..... 439/801
5,897,396 A * 4/1999 Maejima ..... 439/587
5,961,348 A * 10/1999 Murphy ..... 439/579

FOREIGN PATENT DOCUMENTS

KR 95-25953 9/1995

* cited by examiner

*Primary Examiner*—Chandrika Prasad
(74) *Attorney, Agent, or Firm*—McKenna Long & Aldridge LLP

(57) ABSTRACT

A wire-connecting device that is capable of preventing deterioration or breakage of a wire connected to a lamp electrode of a liquid crystal display module. In the device, a clamp presses and secures the electrode to the wire. The lamp electrode and the wire are connected to each other by means of the clamp, providing a secure conductive connection. The wire-connecting device also prevents the penetration of lead by capillary action into the conductive core of the wire, thereby preventing the wire from becoming brittle and subject to breakage as a result of penetrated lead curing in the conductive core of the wire.

11 Claims, 5 Drawing Sheets

WIRE CONNECTING DEVICE

BACKGROUND OF THE INVENTION

1. Field of the Invention

This invention relates to a device for connecting wires, and more particularly to a connecting device that is capable of preventing deterioration or breakage of a wire connected to a lamp electrode of a liquid crystal display module.

2. Description of the Related Art

Generally, a liquid crystal display (LCD) controls the light transmissivity of liquid crystal cells to display a picture corresponding to video signals. The LCD employs an external light unlike display devices such as a cathode ray tube (CRT) that generates a light by itself. The LCD usually uses a back light unit as an external light source, positioned behind and to one side of a liquid crystal display panel. The back light unit includes a lamp for generating light, a light guide plate for guiding the light generated from the lamp located at the side of the LCD panel into the liquid crystal module, and a lamp housing installed at the side of the light guide plate in such a manner as to surround the lamp, so as to improve the light utilization of the lamp. The lamp is connected to a wire that serves as the power supply path. The electrode of the lamp and the wire are usually connected to each other by a soldering method using lead-containing solder. However, when the wire connected by the soldering method is moved, it is liable to deteriorate or break This problem will be described with reference to the accompanying drawings below.

FIG. 1 is an exploded view of a soldering part between a lamp and a wire in a back light unit, and FIG. 2 illustrates a soldered state between the lamp and the wire illustrated in FIG. 1. In FIG. 1 and FIG. 2, the wire 4 passes through a lamp holder 6 to be connected to an electrode 8 of the lamp 2. The lamp 2 is located at one end of a back light support member 12 in such a manner as to be surrounded with a lamp housing 10. One end of the lamp housing 10 is internally inserted in and secured to the lamp holder 6. The wire 4 is connected, via a through hole formed in the interior of the lamp holder 6, to an electrode 8 of the lamp 2 to which it applies a supply voltage. To this end, the wire 4 is usually connected to the electrode 8 of the lamp 2 by the soldering method using lead-containing solder.

When the electrode 8 of the lamp 2 is connected to the wire 4 by the soldering method using lead-containing solder, however, lead penetrates into the core of wire 4 due to capillary action becomes cured. When lead penetrates and cures in the conductive core of a wire, the wire becomes brittle and subject to breaking. As a result, if the wire 4 is moved in the course of carrying out the assembly, inspection and/or transportation of the LCD module, then the wire 4 is liable to deteriorate or break, thereby generating the serious problem of disabling the LCD.

SUMMARY OF THE INVENTION

Accordingly, it is an object of the present invention to provide a wire-connecting device that is effective in securing a wire while preventing a break of the wire.

A further object of the present invention is to provide a wire-connecting device that is capable of preventing lead penetration in a soldering process employing lead-containing solder.

In order to achieve these and other objects of the invention, a wire-connecting device according to one aspect of the present invention includes a clamping member for pressing and securing the electrode to a wire.

A wire-connecting device according to another aspect of the present invention connects an electrode to a wire by a soldering method employing lead-containing solder, and includes a shut-off member for preventing lead from penetrating into the conductive core of the wire.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
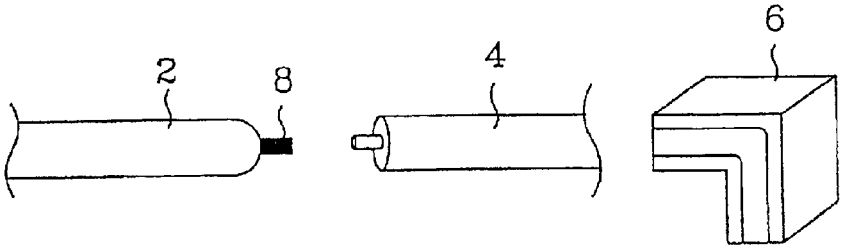
Fig 1 CONVENTIONAL ART
FIG. 1 is an exploded view of a soldering part between a lamp and a wire in a conventional LCD back light unit.
Figure 2:
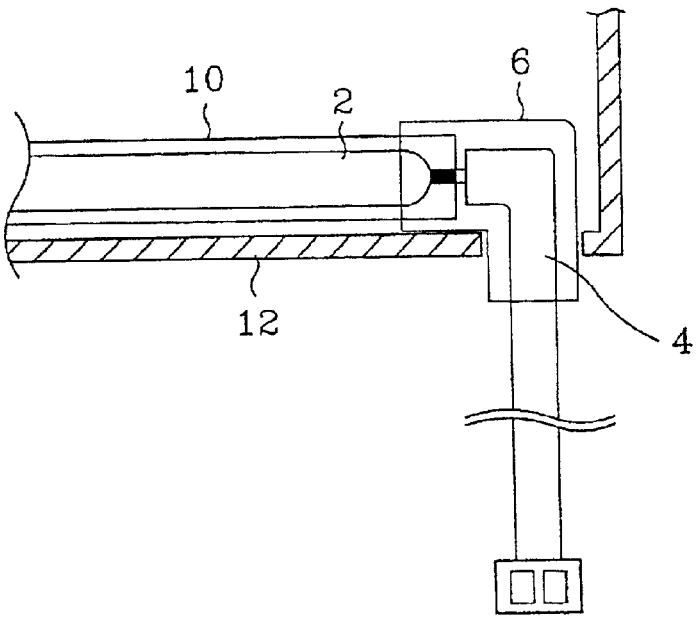
Fig 2 CONVENTIONAL ART
FIG. 2 illustrates a soldered state between the lamp and the wire shown in FIG. 1.
Figure 3:
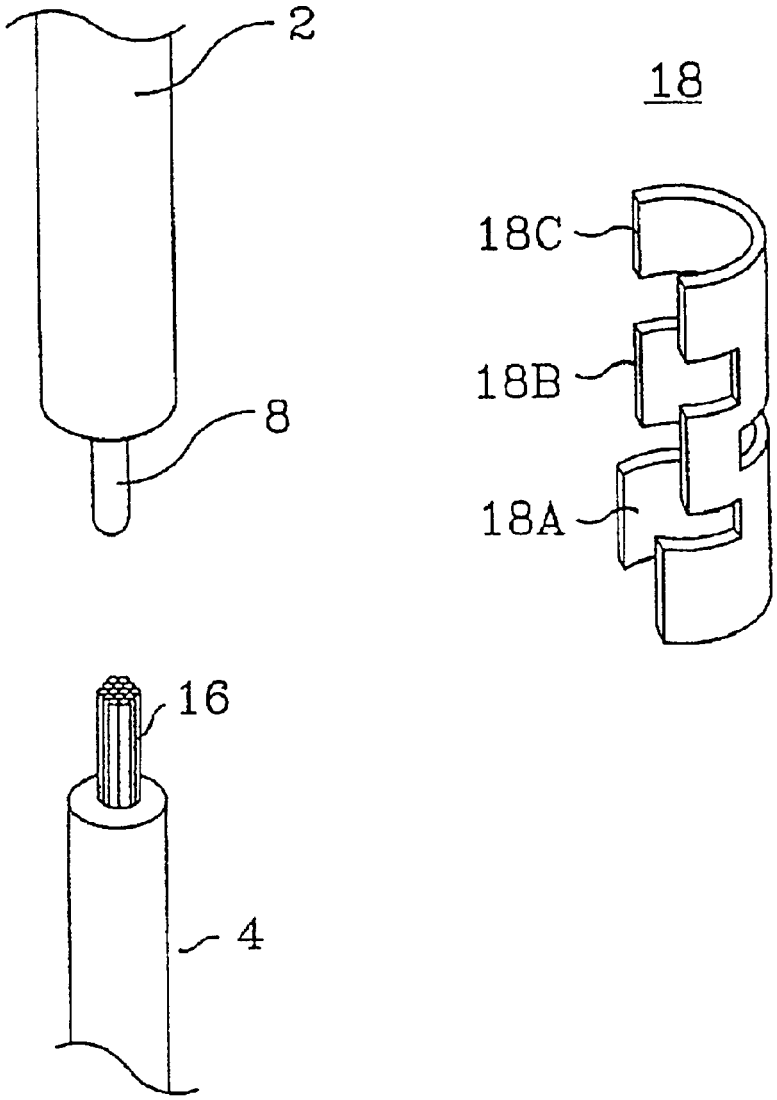
FIG. 3 is an exploded view of a wire-connecting device according to a first embodiment of the present invention.

Referring to FIG. 3, there is shown a wire-connecting device according to a first embodiment of the present invention. The wire-connecting device includes a clamp 18 for connecting an electrode 8 of a lamp 2 to a conductive core 16 of a wire 4 by a press fit method.

In FIG. 3, the clamp 18 includes a wire clamping part 18A pressed and secured to the wire 4, a core clamping part 18B pressed and secured to the core 16, and an electrode clamping part 18C pressed and secured or soldered to the electrode 8 of the lamp 2. In this ilk embodiment of clamp 18, the core clamping part 18B is pressed to the core 16 and the electrode clamping part 18C is pressed or soldered to the electrode 8 of the lamp 2 to connect the wire 4 to the lamp 2. To this end, the clamp 18 is made from a flexible conductive material that may be crimped if desired. Also, the wire clamping part 18A of the damper 18 is pressed to the wire 4 to affix the wire 4. As described above, the core 16 of the wire 4 and the electrode 8 of the lamp 2 are connected to each other by the clamp 18 without using the conventional soldering method employing lead-containing solder. Further, lead penetration by capillary action is prevented by the clamp 18 upon soldering, thereby preventing deterioration or breakage of the wire 4 caused by a curing of lead penetrating into the core 16.

Figure 4A:
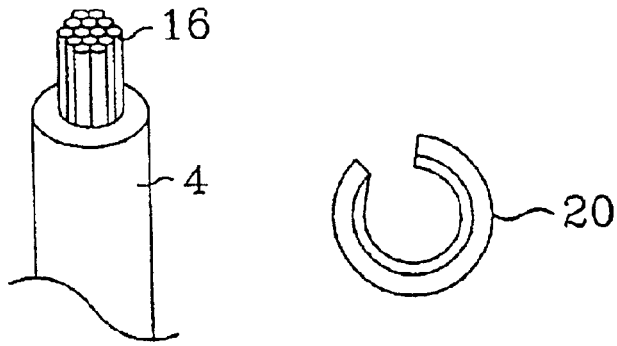
FIG. 4A is an exploded view of a wire-connecting device according to a second embodiment of the present invention.
Figure 4B:
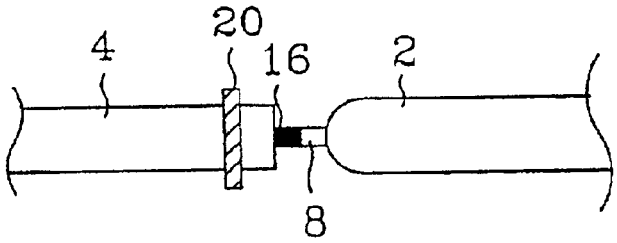
FIG. 4B illustrates a soldering part between the wire and the lamp to which the wire-connecting device in FIG. 4*a* is applied.

FIG. 4A shows a wire connecting device according to a second embodiment of the present invention, and FIG. 4B shows a soldering part between a wire and a lamp to which the wire connecting device in FIG. 4A is applied. Referring to FIG. 4A, the wire-connected device includes a clamp 20 for pressing the wire side of a connection between a wire 4 and an electrode 8 of a lamp 2 where the connection is made by the soldering method employing lead-containing solder. The clamp 20 is pressed and secured to the wire 4 close to the soldering part between the conductive core 16 and the electrode 8 of the lamp 2. In this case, the clamp 20 is made from a flexible material that may be crimped. Thus, when the conductive core 16 of the wire 4 is connected to the electrode 8 of the lamp 2 by the soldering method employing lead-containing solder, the clamp 20 prevents penetration of lead into the conductive core 16. By preventing lead penetration into the conductive core 16 of wire 4, the wire 4 does not become brittle as a result of penetrated lead curing in the conductive core 16. Thus, unlike the prior art, the wire 4 is not susceptible to deterioration and breakage when employing the wire-connecting device of the present invention.

Figure 5:
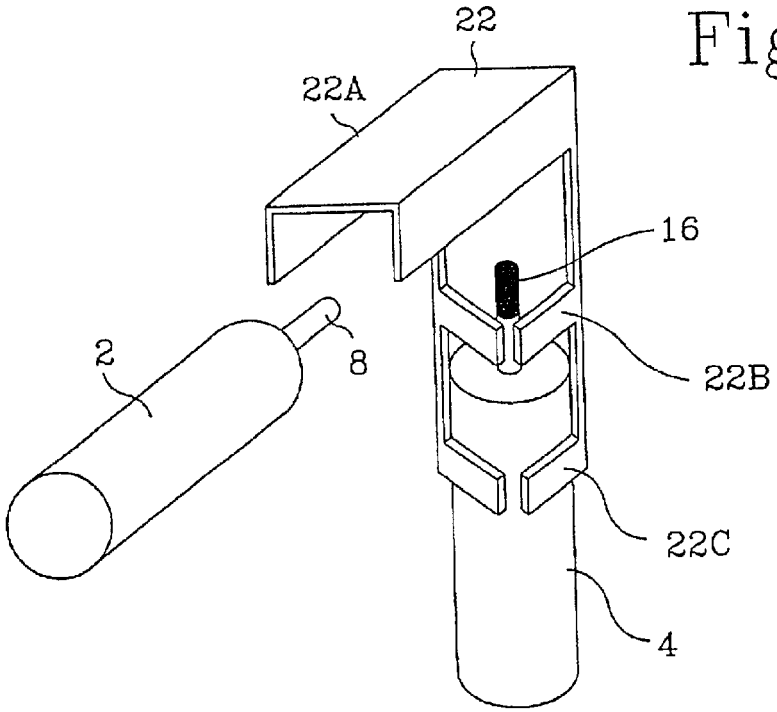
FIG. 5 is an exploded view of a wire-connecting device according to a third embodiment of the present invention.

Referring now to FIG. 5, there is shown a wire-connecting device according to a third embodiment of the present invention. The wire-connecting device includes a clamp 22 having snap-fitted parts to press and connect a lamp 2 to a wire 4.

In FIG. 5, the clamp 22 includes a lamp clamping part 22A pressed and secured to the lamp 2 containing an electrode 8. The clamp 22 further includes a core clamping part 22B pressed and secured to a conductive core 16 of wire 4, and a wire clamping part 22C pressed and secured to the wire 4. The lamp clamping part 22A is snap-fitted perpendicularly to the longitudinal axis of lamp 2 so as to press and secure the lamp 2 and the electrode 8 thereof. The core clamping part 22B is pressed and secured, or soldered to the conductive core 16 of the wire 4. The wire clamping part 22C presses and secures the wire 4. The clamp 22 is made from a flexible conductive material that may optionally be crimped. By this clamp 22, the electrode 8 of the lamp 2 and the conductive core 16 of the wire 4 are securely connected to each other to permit conduction. Wire clamping part 22*c* functions in a manner similar to the clamp 20 of FIGS. 4A and 4B, in that it prevents the penetration of lead by capillary action into the conduction core of wire 4. Thus, when the wire 4 and the electrode 8 of the lamp 2 are connected or soldered to each other with the aid of the clamp 22, deterioration or breakage of the wire 4 caused by the curing of lead penetrated into the conductive core 16 is prevented.

Figure 6:
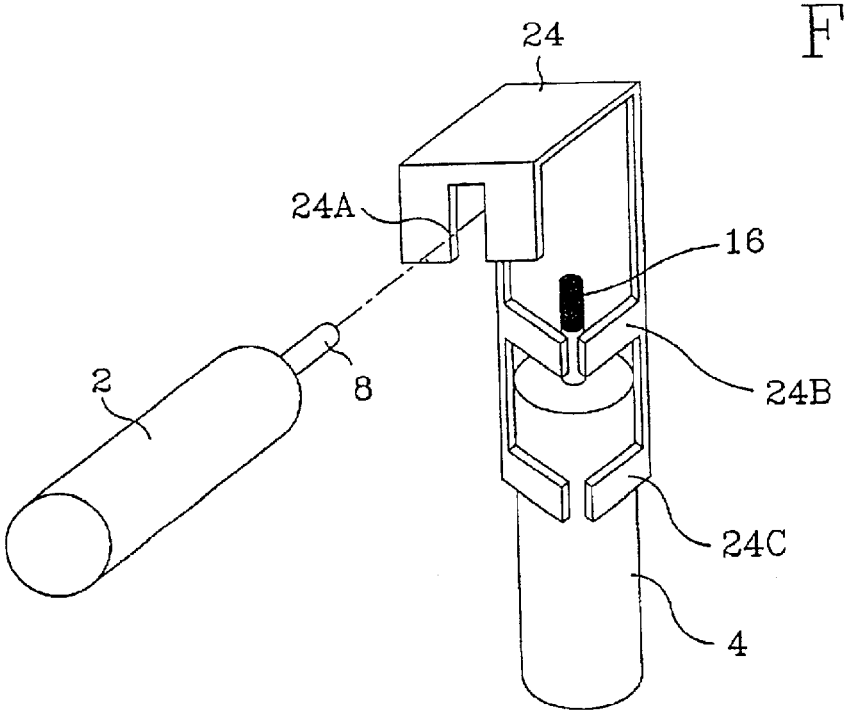
FIG. 6 is an exploded view of a wire connecting device according-to a fourth embodiment of the present invention.

Referring to FIG. 6, there is shown a wire-connecting device according to a fourth embodiment of the present invention. The wire-connecting device includes a clamp 24 having snap-fitted parts to press and connect a lamp 2 to a wire 4.

In FIG. 6, the clamp 24 includes a lamp clamping part 24A pressed and secured to an electrode 8 of the lamp 2, a core clamping part 24B pressed and secured to a conductive core 16, and a wire clamping part 24C pressed and secured to the wire 4. The lamp clamping part 24A is snap-fitted perpendicularly to the longitudinal axis of lamp 2 and is pressed and secured to the electrode 8 of the lamp 2. The core clamping part 24B presses and secures the conductive core 16 of the wire 4, and the wire clamping part 24*c* presses and secures the wire 4. The clamp 24 is made from a flexible conductive material that may be crimped if desired. By this clamp 24, the electrode 8 of the lamp 2 and the conductive core 16 of the wire 16 is connected to each other and thus conducted. As described above, the wire 4 and the electrode 8 of the lamp 2 are connected to each other with the aid of the clamp 24 without using the soldering method employing lead-containing solder, thereby preventing penetration and curing of lead in the conductive core 16, as well as any resultant deterioration or breakage.

Figure 7:
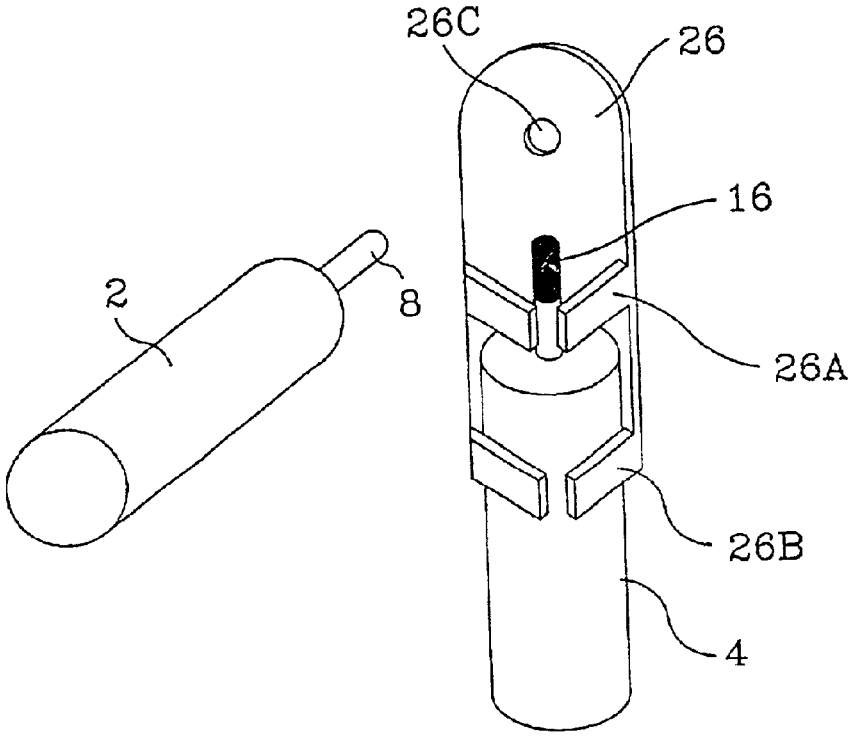
FIG. 7 is an exploded view of a wire-connecting device according to a fifth embodiment of the present invention.

Referring to FIG. 7, there is shown a wire-connecting device according to a fifth embodiment of the present invention. The wire-connected device includes a clamp 26 having a hole 26C for inserting an electrode 8 of a lamp 2 to press and secure a wire 4.

In FIG. 7, the clamp 26 includes a core clamping part 26A for pressing and securing a conductive core 16 of the wire 4, a wire clamping part 26B for pressing and securing the wire 4, and the hole 26C into which the electrode 8 of the lamp 2 is inserted. The clamp 26 is made from a flexible conductive material that may be crimped. The core clamping part 26A is pressed and secured, or soldered to the conductive core 16 of the wire 4. The wire clamping part 26B presses and secures the wire 4. The electrode 8 of the lamp 2 is inserted into the hole 26C provided at the upper portion of the clamp 26 and is connected to the clamp 26 by the soldering method employing lead-containing solder. Accordingly, the electrode 8 of the lamp 2 and the conductive core 16 of the wire 4 are securely connected to each other with the aid of the clamp 26 to permit conduction. Wire clamping part 26B functions in a manner similar to the wire clamping part 24*c* of FIG. 6, in that it prevents the penetration of lead by capillary action into the conduction core 16 of wire 4. Accordingly, deterioration or breakage of the wire 4 caused by the curing of penetrated lead in the conductive core 16 is prevented.

As described above, according to several embodiments of the present invention, the electrode 8 of the lamp 2 and the wire 4 are connected or soldered to each other with the aid of a clamp that prevents penetration of lead by capillary action into the conductive core 16 of wire 4. Thus deterioration or breakage of the wire 4 caused by lead curing in the conductive core 16 of wire 4 as in the prior art can be prevented. Also, the use of a clamp for connecting lamp 2 to wire 4 creates a stronger connection, further preventing deterioration and breakage of the wire 4 or the connection.

Although the present invention has been explained by the exemplary embodiments shown in the drawings described above, it should be understood to those persons of ordinary skill in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An element for electrically connecting an electrode connected to a lamp to a wire having an exterior sheath and a conductive core, comprising:

a body having first arms for pressing and securing the wire, said body further having second arms for pressing and securing the conductive core; and a clamping part having a snap-fit part with a slot extending substantially perpendicular to a longitudinal axis of the lamp such that the lamp is snap-fitted by pressing the lamp into the slot substantially perpendicular to a longitudinal axis of the lamp and the clamping part integrally extending at an angle from said body, said clamping part for securing an end of said lamp and the electrode of said lamp.

2. An element according to claim 1, wherein said slot is dimensioned to snap-fit with the electrode.

3. An element according to claim 1, wherein said clamping part extends at an angle of 90 degrees from said body.

4. An element according to claim 1, wherein said body is solderable.

5. A device according to claim 4, wherein said first arms can clinch the wire such that solder is prevented from flowing up the conductive core.

6. A device for connecting an electrode from a lamp to a wire having a conductive core, comprising:

an elongated body comprised of a conductive material, said body having a first pair of arms positioned to meet the wire and a second pair of arms positioned to meet the conductive core, wherein said first pair of arms can clinch the wire, and wherein said second pair of arms can bend to clinch the conductive core;

a clamp that is integral with, and angularly extends from, said body; and a clamping structure that is integral with, and angularly extends from, said clamp, said clamping structure having a slotted opening extending substantially perpendicular to a longitudinal axis of the lamp and dimensioned to snap-fit with the electrode such that the lamp is snap-fitted by pressing the lamp into the slotted opening substantially perpendicular to a longitudinal axis of the lamp, wherein the electrode and the lamp are fixed by the clamp and the clamping structure.

7. A device according to claim 6, wherein said clamp angularly extends at substantially 90 degrees from said body.

8. A device according to claim 6, wherein said clamping structure angularly extends at substantially 90 degrees from said clamp.

9. A device according to claim 8, wherein said clamping structure and said body are substantially parallel.

10. A device according to claim 6, wherein said body is solderable.

11. A device according to claim 6, wherein said first pair of arms can clinch the wire to prevent solder from flowing up the wire.

* * * * *